US009318045B2

(12) United States Patent
Kasai

(10) Patent No.: US 9,318,045 B2
(45) Date of Patent: Apr. 19, 2016

(54) ELECTRO-OPTICAL DEVICE, METHOD FOR DRIVING ELECTRO-OPTICAL DEVICE, AND ELECTRONIC APPARATUS

(75) Inventor: Toshiyuki Kasai, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 493 days.

(21) Appl. No.: 13/572,266

(22) Filed: Aug. 10, 2012

(65) Prior Publication Data

US 2013/0038585 A1 Feb. 14, 2013

(30) Foreign Application Priority Data

Aug. 10, 2011 (JP) ..... 2011-174639

(51) Int. Cl.
*G09G 3/30* (2006.01)
*G09G 3/32* (2006.01)

(52) U.S. Cl.
CPC ..... *G09G 3/3225* (2013.01); *G09G 3/30* (2013.01); *G09G 2300/0842* (2013.01)

(58) Field of Classification Search
CPC . G09G 3/2011; G09G 3/3648; G09G 3/3655; G09G 3/3225; G09G 3/30; G09G 3/32; G09G 3/3208; G09G 3/3216; G09G 3/3241; G09G 3/325; G09G 3/3258; G09G 3/3266; G09G 3/3275; G09G 3/3283; G09G 3/3291; G09G 2300/0421; G09G 2300/0426; G09G 2300/043; G09G 2300/0842; G09G 2310/0264; G09G 2310/027; G09G 2310/0272; G09G 2310/0275; G09G 2310/0278; G09G 2320/00; G09G 2320/02; G09G 2320/0204; G09G 2320/0228
USPC ..... 345/44–45, 55, 76–92; 315/169.3
See application file for complete search history.

(56) References Cited

U.S. PATENT DOCUMENTS

| | | | | |
|---|---|---|---|---|
| 2002/0033790 | A1* | 3/2002 | Sato et al. | 345/90 |
| 2002/0036606 | A1* | 3/2002 | Ichikawa | G09G 3/3659 345/87 |
| 2003/0164685 | A1* | 9/2003 | Inukai | 315/169.3 |
| 2006/0274015 | A1* | 12/2006 | Endo et al. | 345/98 |
| 2007/0229428 | A1 | 10/2007 | Nakagawa et al. | |
| 2007/0236440 | A1 | 10/2007 | Wacyk et al. | |
| 2010/0134396 | A1* | 6/2010 | Umezaki | 345/92 |

FOREIGN PATENT DOCUMENTS

| | | | |
|---|---|---|---|
| JP | 2000-180884 | A | 6/2000 |
| JP | 2003-058107 | A | 2/2003 |
| JP | 2007-271972 | A | 10/2007 |
| JP | A-2009-152113 | | 7/2009 |
| JP | 2009-181094 | A | 8/2009 |

* cited by examiner

*Primary Examiner* — Lun-Yi Lao
*Assistant Examiner* — Jarurat Suteerawongsa
(74) *Attorney, Agent, or Firm* — Oliff PLC

(57) ABSTRACT

An electro-optical device includes a display unit in which a plurality of pixel circuits is arranged; and a driving circuit that is disposed to be distanced from the display unit and outputs a signal for driving the plurality of pixel circuits. The display unit and the driving circuit are formed on a first surface of a semiconductor substrate. Each of the pixel circuits has a first transistor, the driving circuit has a second transistor, and the first transistor is formed in a first well and a first substrate potential is supplied. The second transistor is formed in a second well, the first well has the same conductivity type as the second well has, and the first well and the second well are separated from each other.

18 Claims, 7 Drawing Sheets

ELECTRO-OPTICAL DEVICE, METHOD FOR DRIVING ELECTRO-OPTICAL DEVICE, AND ELECTRONIC APPARATUS

BACKGROUND

1. Priority Information

This application claims priority under 35 U.S.C. §119 to Japanese Patent Application No. 2011-174639, filed Aug. 10, 2011, the disclosure of which is herein incorporated by reference in its entirety.

2. Technical Field

The present invention relates to an electro-optical device including a pixel circuit formed on a semiconductor substrate, a method for driving an electro-optical device, and an electronic apparatus.

3. Related Art

In recent years, various electro-optical devices using electro-optical elements such as light emitting elements and liquid crystal elements have been suggested. In the electro-optical device, pixel circuits corresponding to intersections of scanning lines and data lines are generally formed on a glass substrate. The pixel circuit includes a transistor in addition to the electro-optical element. The transistor is configured with generally a thin film transistor since the pixel circuit is formed on the glass substrate.

Meanwhile, in recent years, technologies are suggested in which the electro-optical device is formed on a semiconductor substrate represented as a silicon substrate, instead of using the glass substrate, to realize a display size reduction and high resolution display (for example, see US Patent 2007/0236440 and JP-A-2009-152113).

However, when the pixel circuit is formed on the semiconductor substrate, various problems may arise in comparison with the case in which the pixel circuit is formed on the glass substrate.

SUMMARY

An advantage of some aspects of the invention is to provide an electro-optical device, a method for driving an electro-optical device, and an electronic apparatus considering the problems when a pixel circuit is formed on a semiconductor substrate.

According to an aspect of the invention, there is provided an electro-optical device including: a display unit in which a plurality of pixel circuits is arranged; and a driving circuit which is disposed on the outside of the display unit to be distanced from the display unit and outputs a signal for driving the plurality of pixel circuits. The display unit and the driving circuit are formed on a semiconductor substrate. The plurality of pixel circuits configuring the display unit are formed with a single first well, and each of the pixel circuits has one or more transistors. The transistor is formed in the single first well and a common substrate potential is supplied to the transistors. The driving circuit has a plurality of transistors and at least one of the transistors included in the driving circuit is formed in a second well. The first well has the same conductivity type as the second well has and the first well and the second well are separated from each other in plan view.

In the electro-optical device, since the single well of the display unit is surrounded by wells with different polarity from the single well, noise caused by operating the driving circuit may not be easily transmitted to the display unit and the noise rarely has an influence on a display.

In the electro-optical device, the pixel circuit may further include a switching transistor and an electro-optical element, and when the switching transistor is turned ON, a voltage may be applied in accordance with the target luminance of the electro-optical element. In this configuration, it is preferable that the pixel circuit have a driving transistor and the electro-optical element be a light emitting element which emits light of a luminance corresponding to a flowing current. The driving transistor and the light emitting element may be connected between a first power supply and a second power supply in series and the driving transistor may supply the current to the light emitting element in accordance with the voltage applied at the time of the switching transistor being turned ON. According to this configuration, since the switching transistor and the driving transistor have the common substrate potential and a single channel type substrate potential of the display unit is stabilized, the current flowing from the driving transistor may be stabilized.

When the substrate potential is the same as the potential of the first power supply, a separate feeder may not be provided thereby simplifying the configuration. Meanwhile, the substrate potential may be different from the potential of the first power supply.

It is preferable that the driving transistor be made up of two or more transistors in series with gates commonly connected and the two or more transistors have a common substrate potential. According to this configuration, even when a power supply voltage is increased, the pressure resistance of the transistor need not be increased.

In the electro-optical device, a well of the same polarity as a polarity of the display unit has may be formed on a side facing the display unit of a driving unit provided with the driving circuit in plan view. According to this configuration, noise caused by operating the driving circuit is not easily transmitted to the display unit.

According to another aspects of the invention, there are provided, besides the electro-optical device, a method for driving an electro-optical device and an electronic apparatus including the electro-optical device of the above aspect. Typically, the electronic apparatus may be a display device such as a head mounted display or an electronic view finder.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
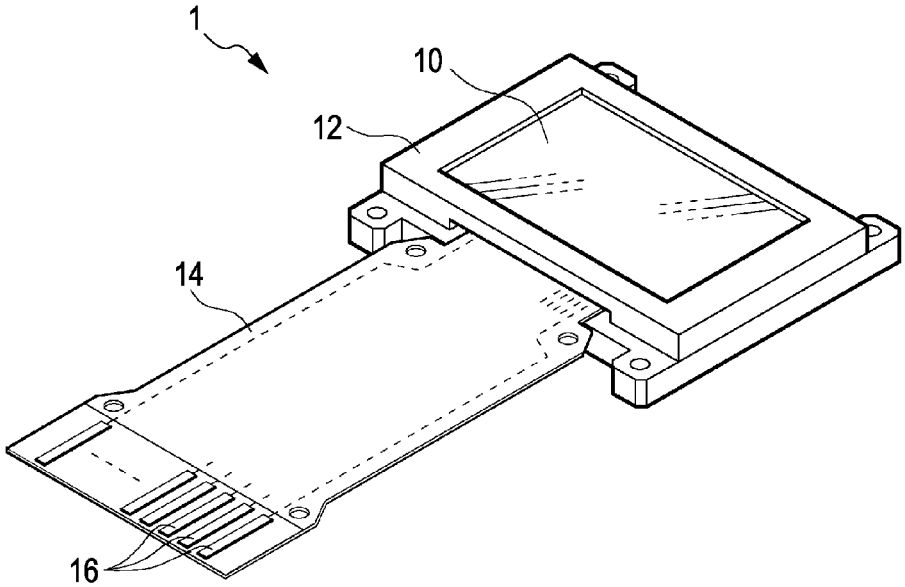
FIG. 1 is a perspective view showing an electro-optical device according to an embodiment of the invention.

FIG. 1 is a perspective view showing an electro-optical device 1 according to an embodiment of the invention.

The electro-optical device 1 in the drawing includes a micro display 10 which is applied to a head mounted display (HMD) to display an image, for example. The micro display 10 is an organic EL device in which plural pixel circuits, driving circuits driving the pixel circuits and the like are formed on a semiconductor substrate which is represented as silicon. The pixel circuit has an Organic Light Emitting Diode (referred to as "OLED" hereinafter) as an example of a light emitting element. In the description below, a silicon substrate may be exemplified as a preferred semiconductor substrate in the invention. However, semiconductor substrates made of other known semiconductor materials may be applied to the invention in the same way.

The micro display 10 is accommodated in a frame-shaped case 12 opened in a display unit and is connected to one end of a Flexible Printed Circuit (FPC) substrate 14. Plural terminals 16 are provided on other end of the FPC substrate 14 and are connected to a circuit module (not shown). The circuit module connected to the terminals 16 is a power supply circuit and a control circuit of the micro display 10, feeds various potentials through the FPC substrate 14, and supplies a data signal, a control signal and the like.

Figure 2:
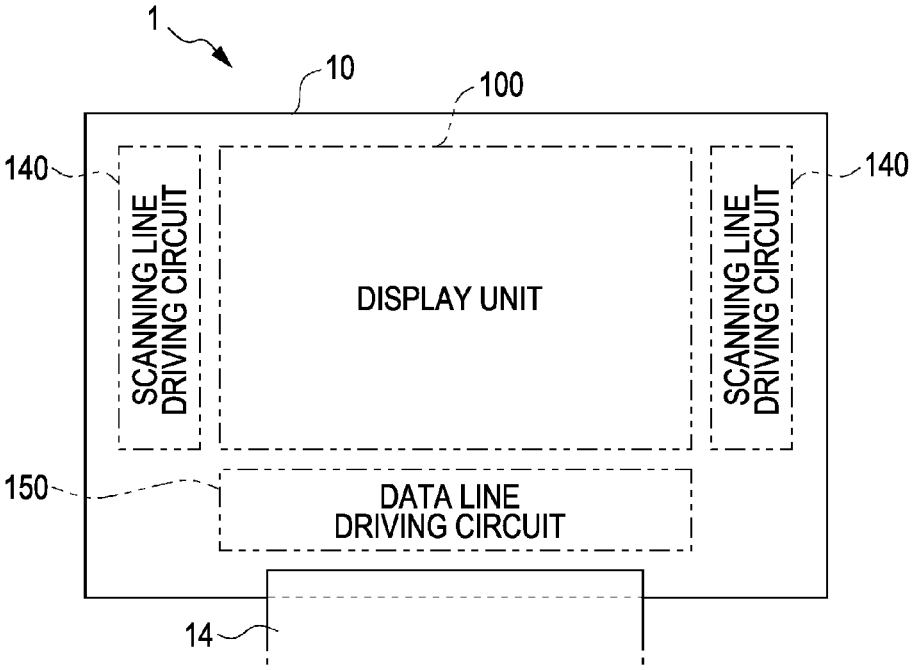
FIG. 2 is a plan view showing an arrangement of each unit in the electro-optical device.
Figure 3:
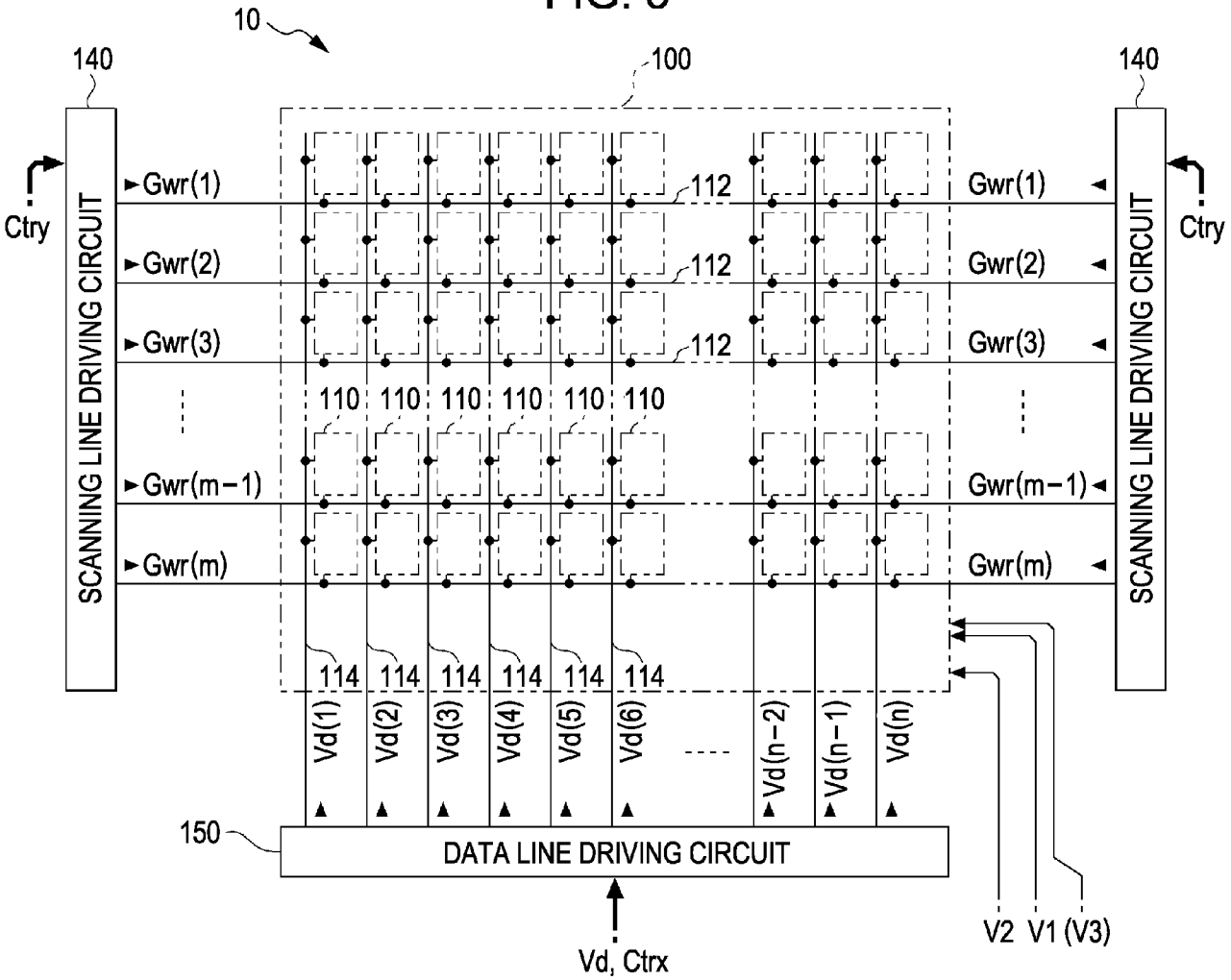
FIG. 3 a block diagram showing an electrical configuration in the electro-optical device.

FIG. 2 is a plan view showing an arrangement of each unit in the micro display 10 and FIG. 3 is a block diagram showing an electrical configuration in the micro display 10. In FIG. 2, for convenience of explanation, the case 12 in FIG. 1 is removed from the micro display 10.

In FIG. 2, the display unit 100 has, for example, a rectangular shape with approximately an inch length in a diagonal direction and long sides in a horizontal direction in plan view. As describing the display unit referring to FIG. 3 in detail, the display unit 100 is provided with m rows of scanning lines 112 in a horizontal direction and n columns of data lines 114 in a vertical direction in the drawing, and each scanning line 112 is provided to keep an electrical insulation state with each data line. For this reason, the pixel circuits 110 are arranged in a matrix shape in the display unit 100 with respect to the respective intersections of m rows of the scanning lines 112 and n columns of the data lines 114.

Both m and n are natural numbers. In the matrix of the scanning lines 112 and the pixel circuits 110, to distinguish the rows for convenience sake, the scanning lines 112 are referred to as first, second, third, . . . , (m−1)-th, and m-th rows in order from top in FIG. 3 in some cases. In the same way, to distinguish the columns in the matrix of the data lines 114 and the pixel circuits 110 for convenience sake, the data lines 114 are referred to as first, second, third, . . . , (n−1)-th, and n-th columns in order from left in FIG. 3 in some cases.

Practically, for example, three pixel circuits 110 corresponding to the intersections of the scanning line 112 on the same row and three columns of data lines 114 that are adjoined each other correspond respective pixels of red R, green G, and blue B, and these three pixels express one dot of a color image to be displayed. In other words, in this embodiment, color of one dot can be expressed using an additive mixture of colors from light emitting elements of the three pixel circuits 110 of R, G, and B.

A driving circuit (a peripheral circuit) to drive the pixel circuit 110 is provided around the display unit 100. In this embodiment, the driving circuit is exemplified as a scanning line driving circuit 140 and a data line driving circuit 150 and among the driving circuits, the scanning line driving circuit 140 is respectively provided on both left and right sides with respect to the display unit 100 to be distanced from the display unit 100. As shown in detail in FIG. 3, the two scanning line driving circuits 140 respectively drive m rows of the scanning lines 112 from both sides. The same control signal Ctry is supplied to each of the scanning line driving circuits 140 from the circuit module, and each of the scanning line driving circuits 140 respectively supplies the same scanning signals Gwr(1), Gwr(2), Gwr(3), . . . , Gwr(m−1), and Gwr(m) to the scanning lines 112 of first, second, third, . . . , (m−1)-th, and m-th rows.

When delaying the scanning signals is not a problem during the supplying, the scanning line driving circuit 140 may be provided on only, one side.

As shown in FIG. 2, the data line driving circuit 150 is provided between a place connected to an FPC substrate 14 and the display unit 100 to be distanced from the display unit 100. As shown in FIG. 3, an image signal Vd and the control signal Ctrx are supplied to the data line driving circuit 150 from the circuit module. The data line driving circuit 150 supplies the image signal Vd to the data lines 114 of first, second, third, . . . , (n−1)-th and n-th columns as data signals Vd(1), Vd(2), Vd(3), . . . , Vd(n−1), and Vd(n) according to the control signal Ctrx.

In this embodiment, potentials V1 and V2 are supplied to the display unit 100 across each pixel circuit 110 and through the FPC substrate 14 from the circuit module.

The pixel circuit 110, the scanning line driving circuit 140 and the data line driving circuit 150 are formed on a common silicon substrate. Among the circuits, the scanning signals Gwr(1) to Gwr(m) which are output from the scanning line driving circuit 140 are logic signals defined at H or L level. For this reason, the scanning line driving circuit 140 is an assembly of a Complementary Metal Oxide Semiconductor (CMOS) logic circuit which operates according to the control signal Ctry. In the scanning line driving circuit 140, a high power supply is set to a potential Vdd, a low power supply is set to a potential Vss. Due to this, H level corresponds the potential Vdd and L level corresponds the potential Vss in the scanning signals Gwr(1) to Gwr(m).

The data signals Vd(1) to Vd(n) output by the data line driving circuit 150 are analog signals. However, the data line driving circuit 150 sequentially supplies the data signal Vd supplied from the circuit module to the date lines 114 of the first to n-th columns according to the control signal Ctrx. For this reason, the data line driving circuit 150 has a CMOS logic circuit. On the other hand, the pixel circuit 110 has plural transistors as described below and all transistors are P-channel transistors in this embodiment.

Accordingly, the micro display 10 formed with the silicon substrate has well regions in the following manner.

Figure 4:
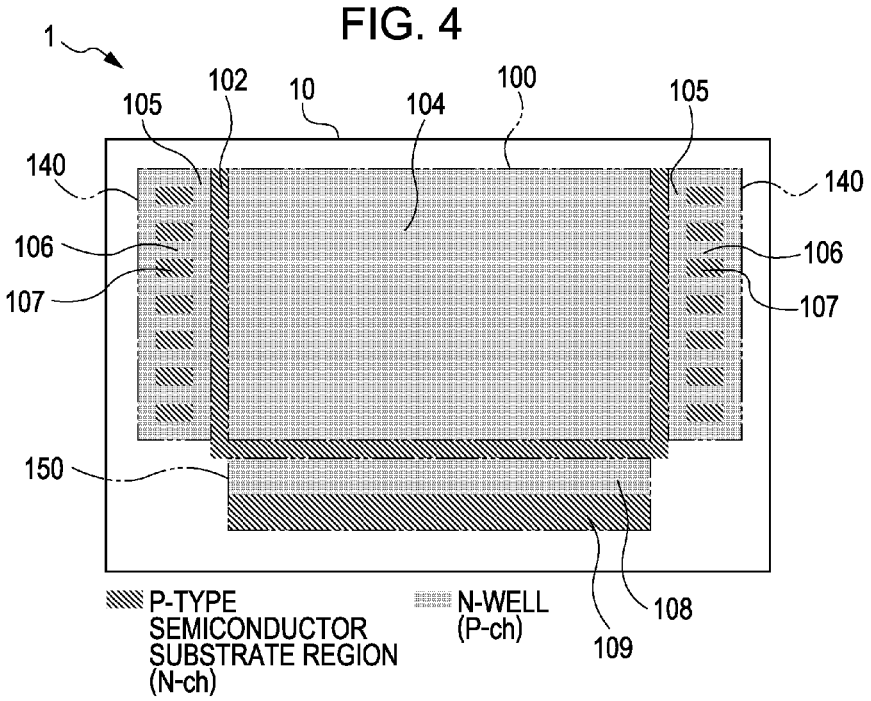
FIG. 4 is a view showing well regions in the electro-optical device.
Figure 5:
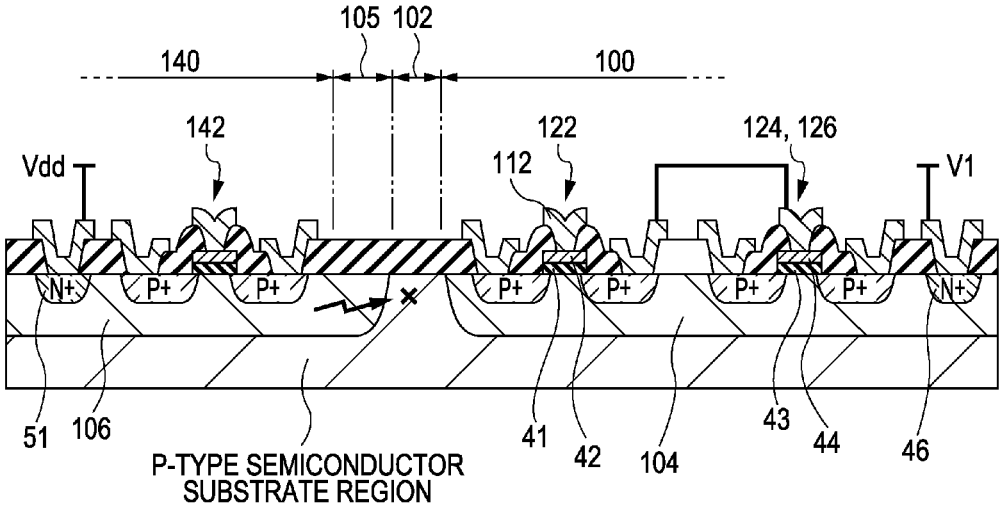
FIG. 5 is a cross-sectional view showing a main part in the electro-optical device.

FIG. 4 schematically shows arrangements of the well regions in the micro display 10 and FIG. 5 is a cross-sectional view showing a main part including a boundary region of the display unit 100 and the scanning line driving circuit 140 in the micro display 10.

For example, when a P-type semiconductor substrate is used as the substrate, an N-type well region (referred to as "N-well" hereinafter) is formed in the following manner.

That is, as shown in FIG. 4, first, the N-well 104 is successively formed across a region corresponding to the display unit 100. Second, in a region corresponding to the scanning line driving circuit 140 of the driving unit which is a region corresponding to the driving circuit (the peripheral unit), the N-wells 105 and 106 are successively formed such that the N-wells bring with plural belt-shaped openings which extend in a transverse direction and surround an edge. Third, the N-well 108 is successively formed across an upper side in FIG. 4 of a region corresponding to the data line driving circuit 150 of the driving unit, that is, an upper region on a side facing the display unit 100.

Resultantly, as shown in FIG. 4, the P-type semiconductor substrate region 102 which has a different conductivity type from the N-wells in the display unit 100 remains at a part where the driving circuit is separated from the display unit 100 such that the P-type semiconductor substrate region is placed on the inside of the driving circuit in plan view and surrounds the display unit 100.

The respective P-type semiconductor substrate regions 107 remain in the openings at the region of the scanning line driving circuit 140. For this reason, the N-well 105 is arranged in a frame shape on the edge of the scanning line driving circuit 140. However, the N-well 106 and the p-type semiconductor substrate region 107 are alternately arranged on the inside of the edge in the vertical direction in the drawing. The p-type semiconductor substrate region 109 remains at the lower region in the drawing of the region of the data line driving circuit 150.

Accordingly, the N-well 104 of the display unit 100 is separated from the N-wells 105, 106 and 108 in the driving unit by the P-type semiconductor substrate region 102, and the P-type semiconductor substrate region 107 in the driving unit is separated by the P-type semiconductor substrate region 102 and the N-well 105.

The P-type impurities may be injected to the P-type semiconductor substrate regions 102, 107 and 109 which are remaining parts due to forming the N-wells 104, 105, 106 and 108 and to form P-wells.

The P-channel transistor formed in the display unit 100 is formed in the N-well 104 as described later. In the CMOS logic circuit included in the scanning line driving circuit 140, the P-channel transistor is formed in the N-wells 105 and 106, and an N-channel transistor is formed in the P-type semiconductor substrate region 107. In the CMOS logic circuit included in the data line driving circuit 150, the P-channel transistor is formed in the N-well 108 and the N-channel transistor is formed in the P-type semiconductor substrate region 109.

In FIG. 4, seven rows of the P-type semiconductor substrate regions 107 are arranged in the respective region of the scanning line driving circuit 140. In this embodiment, for example, the N-well 106 and the P-type semiconductor substrate region 107 which are adjacent to each other correspond to one row, and m rows which are the number of the rows in pixel circuit 110 are practically arranged. When the P-type semiconductor substrate is used as the silicon substrate, a blank part where there is no hatching in the drawing becomes the P-type semiconductor substrate region, which is irrelevant to the invention. Thus, the blank part is shown.

Figure 6:
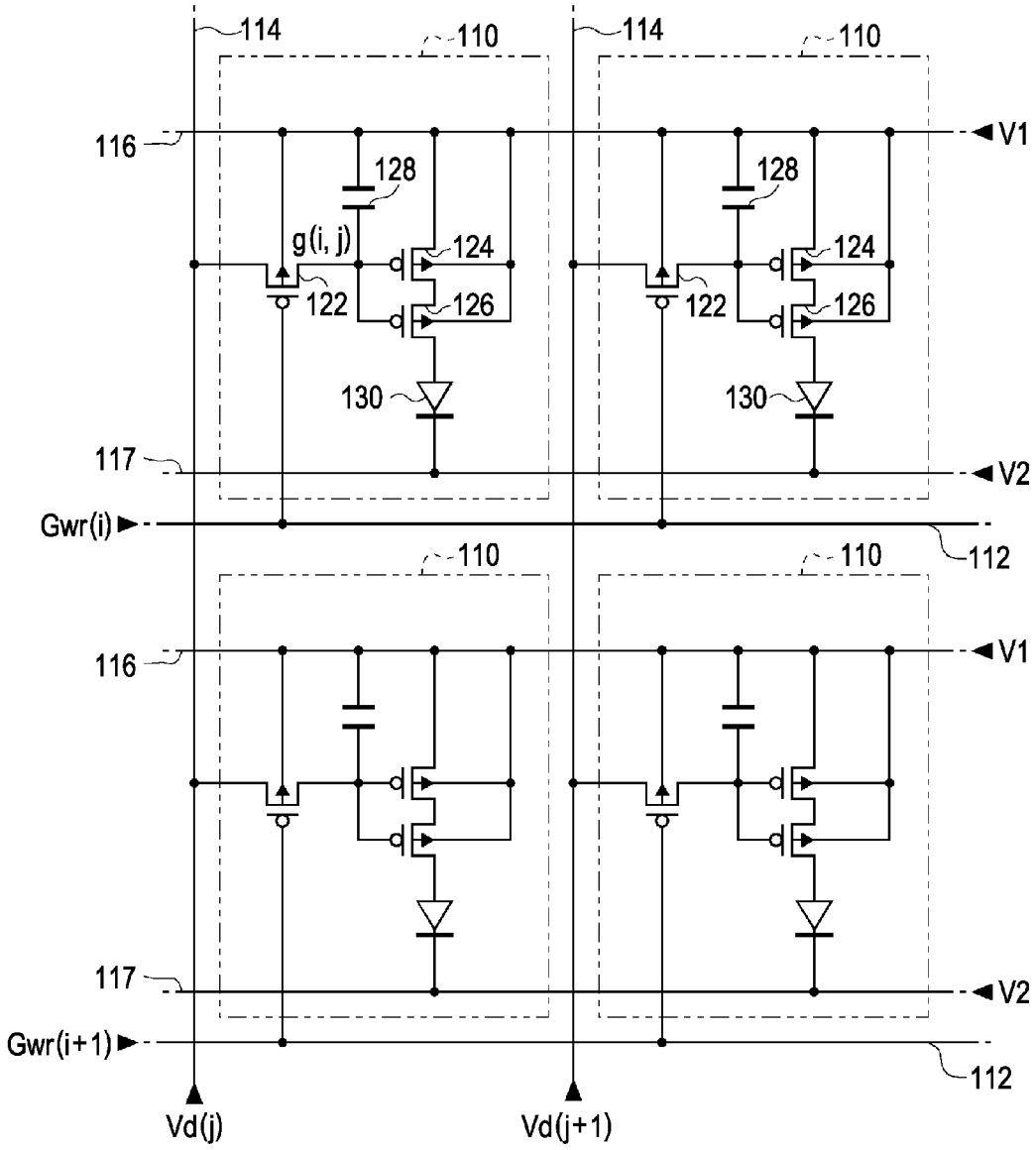
FIG. 6 is a view showing a pixel circuit in the electro-optical device.

FIG. 6 is a circuit diagram of the pixel circuit 110. The pixel circuits 110 of a total of four pixels (2×2) corresponding to the intersection of the scanning line 112 of an (i+1)-th row adjoined on an i-th row and the lower side of the i-th row and the data line 114 of a (j+1)-th column adjoined on a j-th column and right side of the j-th column are shown in this drawing. The i and (i+1) are symbols which generally show the rows arranged with the pixel circuits 110 and integers which are equal to or more than 1 and equal to or less than m. In the same way, the j and the (j+1) are symbols which generally show the columns arranged with the pixel circuits 110 and integers which are equal to or more than 1 and equal to or less than n.

As shown in FIG. 6, each pixel circuit 110 includes P-channel MOS transistors 122, 124 and 126, a capacitative element 128, and an OLED 130. Since each pixel circuit 110 electrically has an identical configuration, the pixel circuit disposed on the i-th row and the j-th column will be representatively described.

The transistor 122 in the pixel circuit 110 on the i-th row and the j-th column functions as a switching transistor. In the transistor 122, a gate node is connected to the i-th scanning line 112, one of a drain or source node of the transistor is connected to the j-th data line 114, and the other of the drain or source node of the transistor is respectively connected to an end of the capacitative element 128 and a common gate node of the transistors 124 and 126.

A source node of the transistor 124 and another end of the capacitative element 128 are connected to a feeder 116 which feeds the potential V1 of the high power supply and a drain node of the transistor 124 is connected to a source node of the transistor 126. A drain node of the transistor 126 is connected to the anode of the OLED 130.

Since the transistor 124 is connected to the transistor 126 in series with the common gate node, the transistors 124 and 126 can be considered as a driving transistor. Specifically, when the transistors 124 and 126 are considered as a driving transistor, the common gate node of the transistors 124 and 126 is a gate, the source node of the transistor 124 is a source, and the drain node of the transistor 126 is a drain. Thus, the driving transistor applies a hold voltage of the capacitative element 128, that is, a current flowing according to a voltage between the gate and the source, to the OLED 130.

The anode of the OLED 130 is a pixel electrode individually provided in each pixel circuit 110. The cathode of the OLED 130 is a common electrode 117 across the all pixel circuits 110, and the potential V2 of the low power supply is fed into the cathode. The OLED 130 is an element with a light emitting layer made of an organic EL material interposed between the anode and the cathode with transparency facing each other and emits light of a luminance corresponding to the current which flows into the cathode from the anode on the silicon substrate.

In FIG. 6, Gwr(i) and Gwr(i+1) are scanning signals which are supplied to the i-th and (i+1)-th scanning lines 112, and Vd(j) and Vd(j+1) are data signals which are supplied to the j-th and (j+1)-th data lines 114.

For convenience sake, the common gate node of the transistors 124 and 126 is marked as g(i,j) in the pixel circuit 110 on the i-th row and the j-th column.

Meanwhile, the capacitative element 128 can use parasitic capacitance of the gate node in the transistors 124 and 126 in some cases.

As shown in FIG. 5, the transistor 122 has the gate node 42 formed on the N-well 104 through an insulating film 41 and two P-type diffusion layers (P+) formed by implanting ions to the gate node 42 as a mask and the respective diffusion layers are pulled out to be the source node and the drain node.

The transistor 124 has the gate node 44 formed on the N-well 104 through an insulating film 43 and two P-type diffusion layers (P+) formed by implanting ions to the gate node 44 as a mask. Although the transistor 126 is not shown in the drawing, the same will be applied to the transistor 126.

In this embodiment, the transistors 122, 124 and 126 feed the potential V1 into the common N-well 104 through an N-type diffusion layer (N+) 46. Due to this, the substrate potential of the transistors 122, 124 and 126 becomes the potential V1.

A transistor 142 is the P-channel transistor included in the CMOS logic circuit in the scanning line driving circuit 140. The transistor 142 has a gate node formed in the N-well 106 in the region of the scanning line driving circuit 140 through an insulating film and two P-type diffusion layers (P+) formed by implanting ions to the gate node as a mask and the respective diffusion layers are drawn out to be a source node and a drain node. The potential Vdd is fed into the N-well 106 through an N-type diffusion layer (N+) 51. For this reason, the substrate potential of the transistor 142 becomes the potential Vdd.

The potential Vdd may be the same as the potential V1. Although not shown in FIG. 5, the potential Vss and the potential V2 may be the same.

Figure 7:
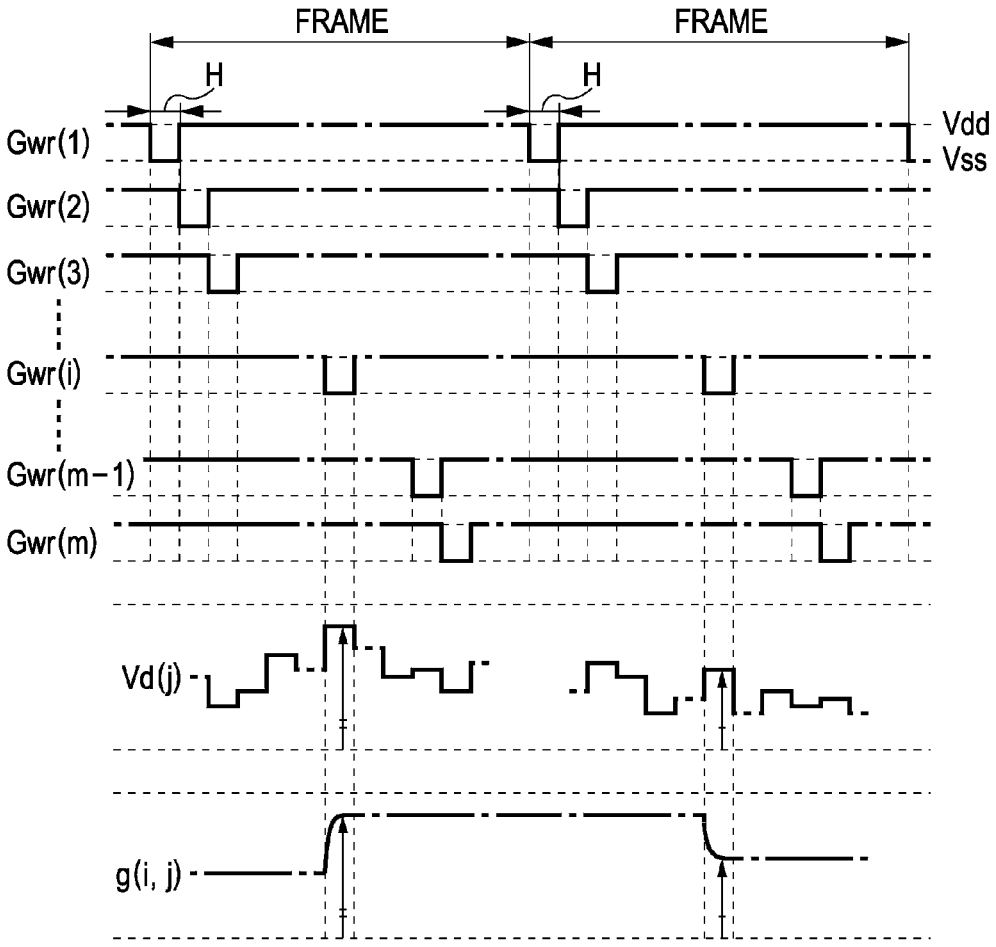
FIG. 7 is a view showing operation of the electro-optical device.

FIG. 7 shows display operation of the micro display 10 and an example showing waveforms of the scanning signals and data signals.

As shown in the drawing, the scanning signals of Gwr(1), Gwr(2), Gwr(3), . . . , Gwr(m−1) and Gwr(m) are sequentially selected in every horizontal scanning period (H) across each frame by the scanning line driving circuit 140 and exclusively become L level.

The frame is the period which is necessary to display an image of one cut (frame) on the micro display 10. When a vertical scanning frequency is 60 Hz, the frame is the period which is 16.67 milliseconds of one cycle in the frequency.

When the scanning line 112 of the i-th row is selected and the scanning signal Gwr(i) becomes L level from H level, the data line driving circuit 150 supplies the data signal Vd(j) of the potential corresponding to the target luminance of the i-th row and the j-th column, that is, the potential corresponding to the current to be flowed into the OLED 130 to the data line 114 of the j-th column.

When the scanning signal Gwr(i) becomes L level in the pixel circuit 110 of the i-th row and the j-th column, the transistor 122 is turned ON and the gate node g(i,j) is electrically connected to the data line 114 of the j-th column. Thus, the potential of the gate node g(i,j) becomes the potential of the data signal Vd(j) as indicated with an up arrow in FIG. 7. At this time, the transistors 124 and 126 supply the potential difference in the gate node g(i,j) and the source node, that is, the current corresponding to the voltage between the gate and the source into the OLED 130 observed at a driving transistor. At this time, the capacitative element 128 maintains the voltage between the gate and the source.

When the selection of the scanning line 112 in the i-th row ends and the scanning signal Gwr(i) becomes H level, the transistor 122 is switched from ON to OFF. Even when the transistor 122 is turned OFF, the potential in the common gate node of the transistors 124 and 126 when the transistor 122 is turned ON is maintained by the capacitative element 128. For this reason, when the transistor 122 is turned OFF, the transistors 124 and 126 keep applying the current corresponding to the hold voltage maintained by the capacitative element 128 to the OLED 130 until the scanning line 112 of next i-th row is selected again. In the pixel circuit 110 of the i-th row and the j-th column, the OLED 130 keeps emitting light over the period corresponding to one frame with a luminance corresponding to the potential of the data signal Vd(j) when the scanning line of the i-th row is selected.

The pixel circuits 110 in the i-th row even columns other than the j-th column emit light of the luminance corresponding to the potentials of the data signals applied to the corresponding data lines 114. The pixel circuits 110 corresponding to the scanning line 112 in the i-th row are described here, but the scanning line 112 is selected in order of first, second, third, . . . , (m−1)-th, and m-th rows so that each pixel circuit 110 emits light of the luminance corresponding to each target value. Such operation is repeatedly performed in every frame.

In FIG. 7, the potential scale of the data signal Vd(j) and gate node g(i,j) is enlarged more than the potential scale of the scanning signal which is a logic signal, for convenience.

In this embodiment, the N-well 104 in the display unit 100 is separated from the N-wells 105, 106 and 108 in the driving circuit by the P-type semiconductor substrate region 102 which surrounds the N-well 104. In other words, among the wells where the transistors included in the scanning line driving circuit 140 are formed, the N-well 105 which is the closest well to the display unit 100 is separated from the N-well 104 in the display unit.

The P-type semiconductor substrate region 107 in the scanning line driving circuit 140 is surrounded by the N-wells 105 and 106, and the P-type semiconductor substrate region 109 in the data line driving circuit 150 is disposed on the side not facing the display unit 100. Thus, the N-well 104 in the display unit 100 is separated from the P-type semiconductor substrate regions 107 and 109 in the driving circuit by the N-wells 105, 106 and 108 adding to the P-type semiconductor substrate region 102.

Since the driving circuit constantly performs logic operations using a clock, the driving circuit becomes a source of noise. To handle this, in this embodiment, the P-type semiconductor substrate region 102 is provided such that the display unit 100 is surrounded with the P-type semiconductor substrate region in plan view, in FIG. 4. For this reason, the noise caused by the driving circuit is absorbed or prevented by the P-type semiconductor substrate region 102 so that display quality deterioration caused by the noise can be suppressed. For example, as shown in FIG. 5, even when the transistor 142 formed on the N-well 106 in the scanning line driving circuit 140 causes noise, the noise is absorbed or prevented by the P-type semiconductor substrate region 102.

According to this embodiment, the display unit 100 operates under the circumstance in which interference is not easily received from the driving circuit, the display quality deterioration can be suppressed.

In the driving transistor having the transistors 124 and 126, from the viewpoint of stabilizing and applying the current, it is preferable to stabilize the substrate potential of the transistors 124 and 126. In this embodiment, all the transistors 122, 124 and 126 of the pixel circuit 110 in the display unit 100 are P-channel type and are formed on the common N-well 104. That is, the common N-well 104 is successively formed across the display unit 100 and this makes possible for the driving transistor to stabilize and apply the current.

Since the power supply applied to the display unit 100 in this embodiment has two kinds of potentials which are the potential V1 and the potential V2 including the substrate potential, it is possible to simplify the configuration.

It is necessary that a power supply voltage which is the difference of the potentials V1 and V2 be increased as far as possible to emit the OLED 130 with a certain degree of luminance. When a low-bit image is displayed, the current flowing to the OLED 130 is decreased, the voltage between the anode of the OLED 130 and the potential V2 is slightly decreased, and the voltage applied between the source and drain of the driving transistor is slightly increased to the extent of the decrease. At last, in the state in which the luminance of the OLED 130 is set to zero, the voltage applied between the source and drain of the driving transistor becomes maximum.

Increasing the size of the transistor and relieving density of the field is necessary to increase the voltage (pressure resistance) applicable between the source and the drain of the transistor on the silicon substrate. When the size reduction of the display unit 100 and high resolution display is required, the size of the transistor formed in the display unit is inevitably reduced, thereby decreasing the pressure resistance. In the configuration having a driving transistor, when the OLED 130 emits light of low luminance, the voltage applied between the source and the drain of the driving transistor exceeds the pressure resistance of the transistor and the transistor may be broken.

In other words, emitting the OLED 130 with high luminance by increasing the power supply voltage and the display size reduction and high resolution display have a trade-off relation so far.

According to this embodiment, the driving transistor has two transistors 124 and 126 which are connected in series. In this configuration, when the current does not flow to the OLED 130, the transistors 124 and 126 are turned OFF, and the drain node of the transistor 124 and the source node of the transistor 126 are in a floating state. Thus, the voltage is not applied between the source node of the transistor 124 and the drain node of the transistor 126. When the small amount of current flows to the OLED 130, a relatively high voltage is applied between the drain of the transistor 124 and the source of the transistor 126. However, the voltage is divided in terms of each transistor 124 and 126, and the high voltage is not applied to the transistors.

Accordingly, when the pressure resistance of each transistor 124 and 126 is decreased, there is no problem.

Thus, it is possible for the OLED 130 to emit light with high luminance and to realize a display size reduction and high resolution display.

In case that emitting the OLED 130 with high luminance or realizing a display size reduction and high resolution display is required, the driving transistor may be configured to have a transistor.

APPLICATION AND MODIFICATION EXAMPLE

The invention is not limited to the above embodiment, but various applications and modifications can be made as described below. The applications and modifications described below can be made by arbitrarily selecting and properly combining one or more embodiments.

Separation of Substrate Potential from Power Supply

Figure 8:
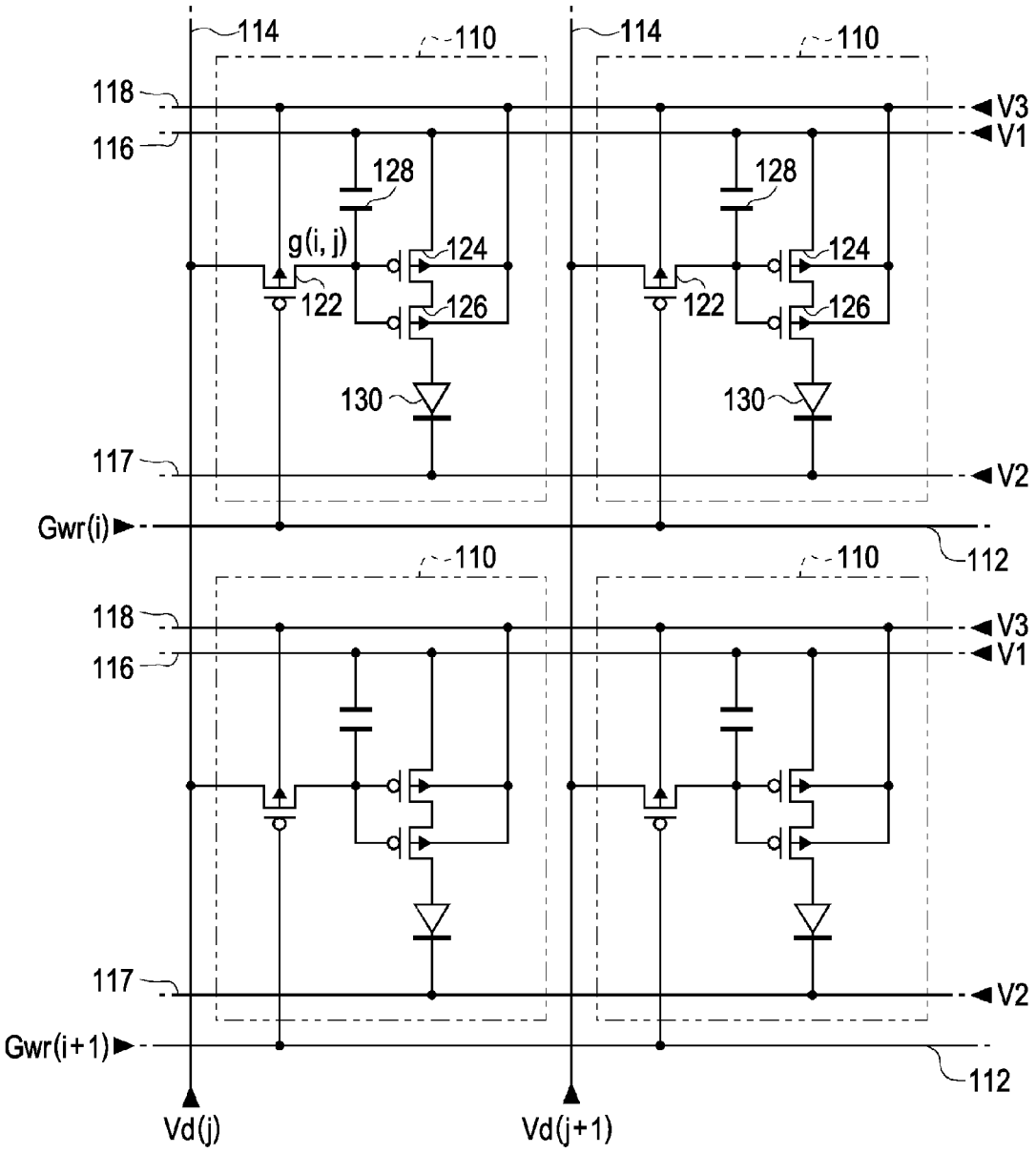
FIG. 8 is a view showing the pixel circuit in the electro-optical device according to an application and modification example.

In this embodiment, the substrate potential of the transistors 122, 124 and 126 is set to the potential V1 to make the substrate potential common with the high power supply but the substrate potential of the transistors 122, 124 and 126 is set to a potential V3 fed through the feeder 118 which is separately provided, and may be separated from the power supply as shown FIG. 8. The potential V3 and the potential V1 may have different potential.

Channel Type of Transistor and the Like

In this embodiment, the transistors 122, 124 and 126 are P-channel type. However, conversely, the transistors may be N-channel type. In case of using the N-channel type, each well is inverted.

When the driving transistors are connected in series, three or more transistors may be connected.

Electro-Optical Element

In this embodiment, OLED which is a light emitting element is exemplified as an electro-optical element, but for example, an inorganic light emitting diode and an Light Emitting Diode (LED) may be used. A liquid crystal element with a liquid crystal layer interposed between a pixel electrode and a common electrode may be used as the electro-optical element other than the light emitting element.

Since the liquid crystal element is a voltage driven type element, there is no need to provide a driving transistor. That is, the liquid crystal element is configured to connect the pixel electrode to a switching transistor, and does not need the driving transistor. In this configuration, a voltage of a data signal applied through a data line, that is, a voltage according to a target luminance is applied to the pixel electrode when the switching transistor is turned ON and is maintained. Since the liquid crystal layer is in an orientation state corresponding to the applied or maintained voltage, the liquid crystal layer has transmittance (or reflectance) corresponding to the voltage as observed at the liquid crystal element.

Electronic Apparatus

Hereinafter, a head mounted display to which the micro display 10 according to an embodiment is applied will be described.

Figure 9:
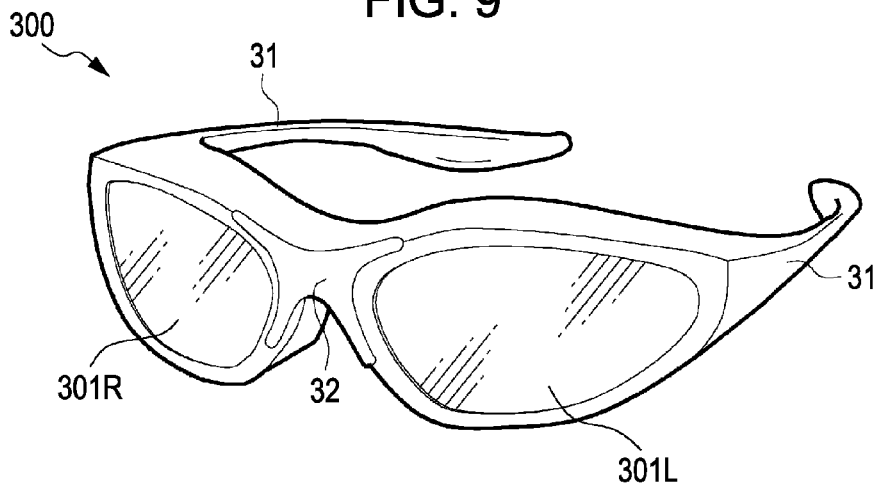
FIG. 9 is a perspective view showing an HMD using the electro-optical device according to the embodiment.
Figure 10:
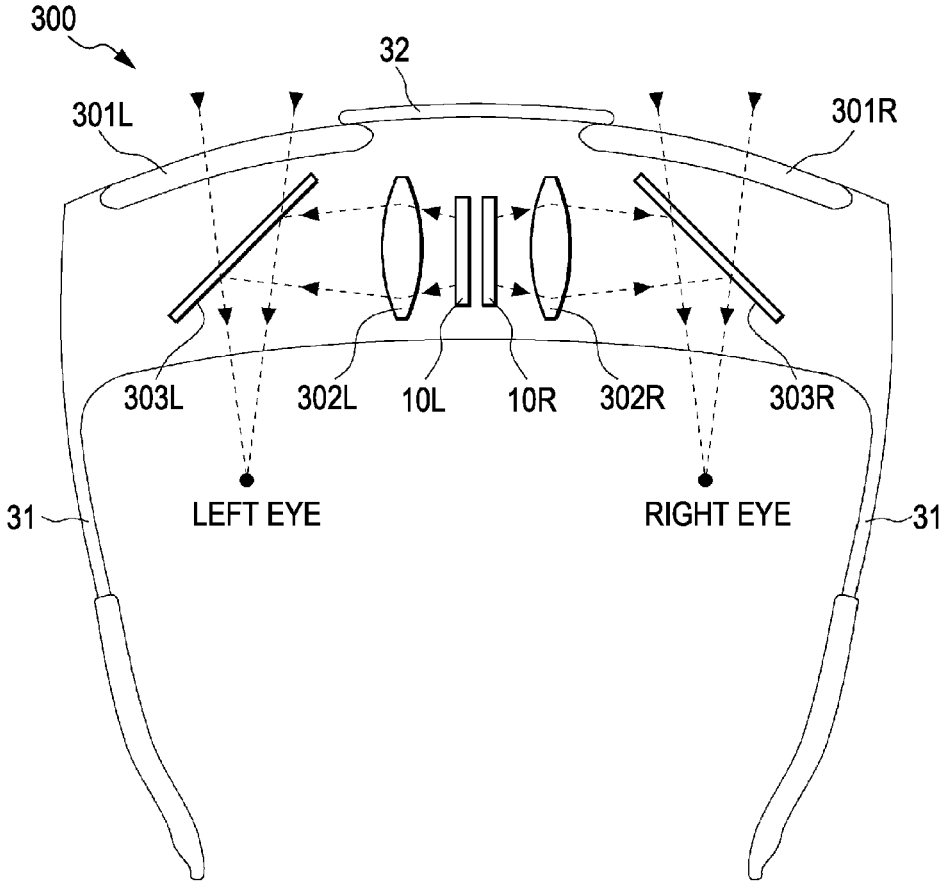
FIG. 10 is a view showing an optical configuration of the HMD.

FIG. 9 shows the appearance of the head mounted display and FIG. 10 shows an optical configuration of the head mounted display.

As shown in FIG. 9, the head mounted display 300 has temples 31, a bridge 32 and lenses 301L and 301R in appearance like normal glasses. The head mounted display 300 is provided with a micro display 10L for left eye and a micro display 10R for right eye on the back side (downside in the drawing) of the lenses 301L and 301R which is near the bridge 32 as shown in FIG. 10.

The micro display 10L has an image display surface on the left side in FIG. 10. Due to this, an image displayed by the micro display 10L is output through an optical lens 302L to the nine o'clock direction in the drawing. A half mirror 303L reflects the image displayed by the micro display 10L to the six o'clock direction and transmits light incident from the twelve o'clock direction.

The micro display 1OR has an image display surface on the right side opposite to the micro display 10L. Due to this, an image displayed by the micro display 10R is output through an optical lens 302R to the three o'clock direction in the drawing. A half mirror 303R reflects the image displayed by the micro display 10R to the six o'clock direction and transmits light incident from the twelve o'clock direction.

In this configuration, a wearer of the head mounted display 300 can see the image displayed from the micro display 10L and 10R in a see-through state in which the display image overlaps what may be seen outside.

When an image for the left eye is displayed on the micro display 10L and an image for the right eye is displayed on the micro display 10R, in images for the left eye and the right eye which have parallax, the wearer can feel as if the displayed images have a depth and a stereoscopic effect in this head mounted display 300 (3D display).

The micro display 10 can be applied to a video camera and an electronic view finder of a digital camera with interchangeable lenses, other than the head mounted display 300.

What is claimed is:

1. An electro-optical device comprising:

a semiconductor substrate having a first well, a second well having a same conductivity type as the first well, a first region and a second region, the first region and the second region having a conductivity type different from that of the first and second wells;

a display unit including a plurality of pixel circuits, each of the pixel circuits including one or more transistors; and a driving circuit, including first conductivity type of transistors and second conductivity of transistors, that is disposed on the outside of the display unit to be distanced from the display unit and outputs a signal for driving the plurality of pixel circuits, wherein the one or more transistors are formed in the first well and a common substrate potential is supplied to the one or more transistors, the first conductivity type of transistors are formed in the second well, the second conductivity of transistors are formed in the first region, the first well and the second well are separated from each other by the second region, and the second well is formed between the first region and the second region.

2. The electro-optical device according to claim 1, wherein each pixel circuit of the plurality of pixel circuits further includes:

a switching transistor; and an electro-optical element, wherein when the switching transistor is turned ON, a voltage is applied in accordance with the target luminance of the electro-optical element.

3. The electro-optical device according to claim 2, wherein each pixel circuit of the plurality of pixel circuits further includes a driving transistor, the electro-optical element is a light emitting element which emits light of a luminance corresponding to a flowing current, the driving transistor and the light emitting element are connected in series between a first power supply and a second power supply, and the driving transistor supplies the current to the light emitting element in accordance with the voltage applied at the time of the switching transistor being turned ON.

4. The electro-optical device according to claim 3, wherein the substrate potential is equal to the potential of the first power supply.

5. An electronic apparatus comprising the electro-optical device according to claim 4.

6. The electro-optical device according to claim 3, wherein the substrate potential is not equal to the potential of the first power supply.

7. An electronic apparatus comprising the electro-optical device according to claim 6.

8. The electro-optical device according to claim 3, wherein the driving transistor includes two or more transistors connected in series with commonly connected gates, and the two or more transistors have a common substrate potential.

9. An electronic apparatus comprising the electro-optical device according to claim 8.

10. An electronic apparatus comprising the electro-optical device according to claim 3.

11. An electronic apparatus comprising the electro-optical device according to claim 2.

12. The electro-optical device according to claim 1, wherein the second well surrounds the second region.

13. An electronic apparatus comprising the electro-optical device according to claim 12.

14. An electronic apparatus comprising the electro-optical device according to claim 1.

15. An electro-optical device comprising:

a semiconductor substrate having a first well, a second well having a same conductivity type as the first well, a first region and a second region, the first region and the second region having a conductivity type different from that of the first and second wells;

a display unit including a plurality of pixel circuits, each of the pixel circuits including a first transistor; and a driving circuit, including first conductivity type of transistors and second conductivity of transistors, that is disposed distanced from the display unit and outputs a signal for driving the plurality of pixel circuits, wherein the first transistor is formed in the first well and a first substrate potential is supplied to the first transistor, the first conductivity type of transistors are formed in the second well, the second conductivity of transistors are formed in the first region, the first well and the second well are separated from each other by the second region, and the second well is formed between the first region and the second region.

16. An electronic apparatus comprising the electro-optical device according to claim 15.

17. A method comprising:

forming a first well on a semiconductor substrate;

forming a second well on the semiconductor substrate, the second well having a same polarity as a polarity of the first well;

forming a display unit in the first well, the display unit including a plurality of pixel circuits;

providing one or more transistors in each pixel circuit of the plurality of pixel circuits;

forming each transistor in the first well and making a substrate potential common;

forming a first substrate region with a different polarity from the polarity of the first well and the second well such that the display unit is surrounded with the first substrate region and the first substrate region is located inside of a driving circuit in plan view to separate the second well from the first; well and forming a second substrate region having a same polarity as the polarity of the first substrate region, wherein the second well is formed between the first substrate region and the second substrate region.

18. An electro-optical device comprising:

a semiconductor substrate of a first conductivity type;

a first well of a second conductivity type formed on the semiconductor substrate;

a first substrate region of the first conductivity type bordering the first well;

a second well of the second conductivity type formed on the semiconductor substrate and separated from the first well by the first substrate region;

a second substrate region of the first conductivity type bordering the second well;

a display unit including a plurality of pixel circuits formed in the first well; and a driving circuit including first conductivity type of transistors formed in the second well and second conductivity of transistors formed in the second substrate region, wherein the second well is formed between the first substrate region and the second substrate region.

* * * * *